US006669454B2

(12) United States Patent
Lal et al.

(10) Patent No.: US 6,669,454 B2
(45) Date of Patent: Dec. 30, 2003

(54) MICROFLUIDIC ACTUATION METHOD AND APPARATUS

(75) Inventors: Amit Lal, Madison, WI (US); Ville Kaajakari, Madison, WI (US); Abhijit Sathaye, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 208 days.

(21) Appl. No.: 09/874,944

(22) Filed: Jun. 5, 2001

(65) Prior Publication Data

US 2002/0179162 A1 Dec. 5, 2002

(51) Int. Cl.[7] ..... F04B 17/03; B06B 1/06

(52) U.S. Cl. ..... 417/410.2; 417/436; 310/321

(58) Field of Search ..... 417/410.2, 410.1, 417/436; 310/300, 309, 323.01, 323.16, 354.311

(56) References Cited

U.S. PATENT DOCUMENTS 4,063,826 A * 12/1977 Riepe ..... 417/410.1
4,742,260 A * 5/1988 Shimizu et al. ..... 310/323.16
4,923,000 A * 5/1990 Nelson ..... 417/436
5,006,749 A 4/1991 White
5,072,288 A * 12/1991 MacDonald et al. ..... 310/309
5,610,468 A 3/1997 Miyazawa et al.
5,619,089 A 4/1997 Suzuki et al.
5,658,698 A * 8/1997 Yagi et al. ..... 310/309
5,735,026 A 4/1998 Min
5,940,947 A 8/1999 Takeuchi et al.

FOREIGN PATENT DOCUMENTS

WO WO 00/75068 12/2000

OTHER PUBLICATIONS

Ville Kaajakari, et al., "Ultrasonically Driven Surface Micromachined Motor," Proceedings of the 13th Annual International Conference on Micro Electro Mechanical Systems, Miyazaki, Japan, Jan. 23–27, 2000, pp. 40–45.

Amil Lal, Micromachined Silicon Ultrasonic Longitudinal Mode Actuators: Theory and Applications to Surgery, Pumping, and Atomization, Ph.D. Thesis, University of California, Berkeley, 1996, pp. 137–177.

* cited by examiner

*Primary Examiner*—Michael Koczo
(74) *Attorney, Agent, or Firm*—Foley & Lardner

(57) ABSTRACT

Control of fluid motion within microcavities is carried out using microstructures in the cavities having cantilever elements that are coupled to a substrate to receive vibrations therefrom. The cantilever elements can be excited into resonance at one or more resonant frequencies. By selection of the shape of the cantilever elements, their position in the microcavity, the spacing of the cantilever elements from the walls of the cavity, and the frequency at which the cantilever elements are excited, the direction of pumping of fluid through the cavity can be controlled, blocked or diverted.

26 Claims, 6 Drawing Sheets

FIG. 7
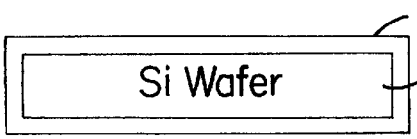
FIG. 8
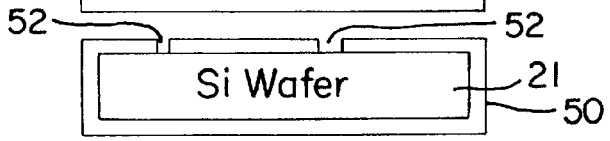
FIG. 9
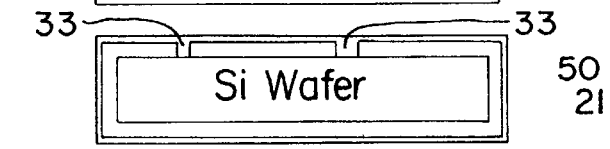
FIG. 10
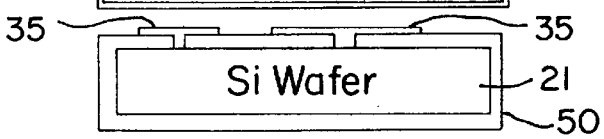
FIG. 11
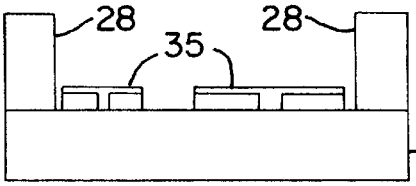
FIG. 12
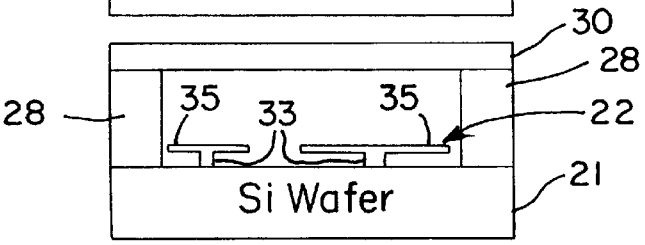
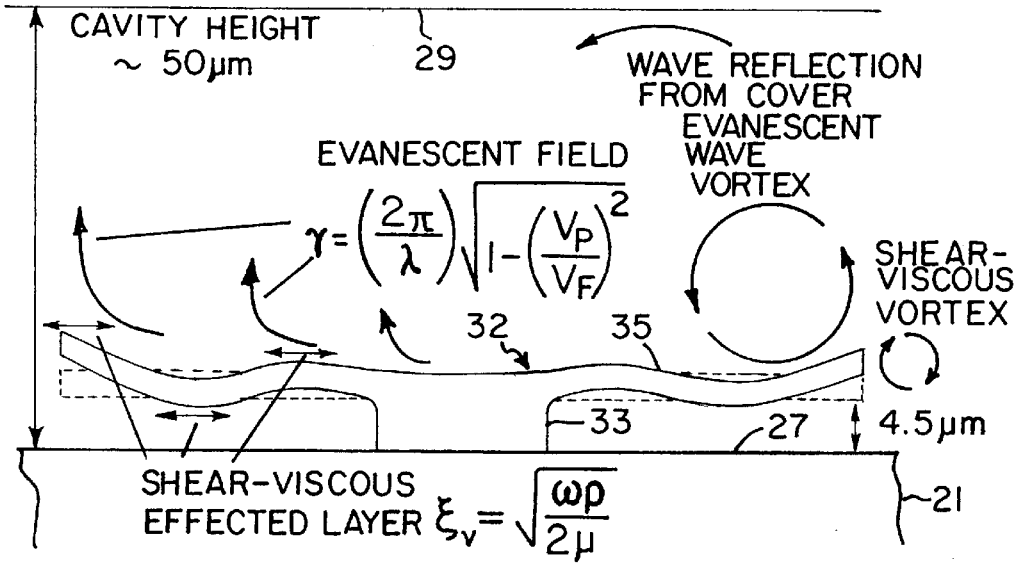
FIG. 13

MICROFLUIDIC ACTUATION METHOD AND APPARATUS

This invention was made with United States government support awarded by the following agencies: DOD AF30602-00-2-0572. The United States has certain rights in this invention.

FIELD OF THE INVENTION

This invention pertains generally to the field of microfluidics and to ultrasonic actuators.

BACKGROUND OF THE INVENTION

Microfluidic devices have potential application in many areas, including the production and analysis of pharmaceuticals, in medical diagnoses, and in drug delivery. A particular problem encountered in devices having microfluidic channels is that the analyte, for example, latex beads with antibodies thereon, is dispersed at low densities along the channel at low Reynold's number flow. The low density results in a low signal to noise ratio in the detected signal, for example, the fluorescent signal from the latex beads. It would be desirable to be able to concentrate the beads in the microfluidic channels to enhance the potential signal to noise ratio.

For applications such as the concentration of analytes as discussed above, and for pumping fluids in microfluidic channels, acoustic streaming has several advantages compared to other techniques. For example, the stress waves responsible for acoustic streaming can be excited far away from the channel, eliminating the need to integrate electrodes in close proximity to the channel. Other pumping or mixing methods such as electro-osmosis, electrohydrodynamic pumping, magneto-hydrodynamic pumping, and electrophoretic pumping require that the liquid be electrically conductive. In contrast, acoustic streaming based ultrasonic pumps or mixers are far less dependent on or sensitive to the electrical or chemical properties of the fluid. Thermal and piezoelectric bimorph pumps are based on large mechanical displacement of the fluid. See, e.g., P. Gravesen, et al., "Microfluidics—a Review," J. of Micromechanics and Microengineering, Vol. 3, No. 4, December 1993, pp. 168–182. In contrast, in acoustic streaming, the displacements are very small (on the order of nanometers), but the high frequencies used result in high particle velocities. Various micro systems have been reported which utilize acoustic streaming. See, e.g., R. Zengerle, et al., "Microfluidics, " Proc. of the Seventh International Symposium on Micro Machine and Human Science, 1996, pp. 13–20; A. Lal, et al., "Ultrasonically Driven Silicon Atomizer and Pump, " Solid State and Actuator Workshop, Hilton Head Island, USA., Jun. 3–6, 1996, pp. 276–279; H. Wang, et al., "Ejection Characteristics of Micromachined Acoustic-Wave Ejector," The 10th International Conference on Solid-State Sensors and Actuators, Sendai, Japan, Jun. 7–10, 1999, pp. 1784–1787; P. Luginbuhl, et al., "Flexural-Plate-Wave Actuators Based on PZT Thin Film, " Proc. of the 10th Annual International Workshop on Micro Electro Mechanical Systems, Nagoya, Japan, Jan. 26–30, 1997, pp. 327–332; R. M. Moroney, et al., "Microtransport Induced by Ultrasonic Lamb Waves, " Vol. 59, No. 7, August 1991, pp. 774–776; X. Zhu, et al., "Microfluidic Motion Generation with Loosely-Focused Acoustic Waves, " The 9th International Conference on Solid-State Sensors and Actuators, Chicago, Ill., Jun. 16–19, 1997, pp. 837–838. A common feature of these investigations is the use of bulk micromachined SiN membranes or bulk silicon which is excited by piezoelectric thin films.

SUMMARY OF THE INVENTION

In accordance with the invention, selective pumping, guiding, mixing, blocking, and diverting of fluids in microcavities in micromechanical systems can be carried out simply and efficiently without requiring mechanical or electrical connections to elements within the microcavities. Further, particles within the fluid in the cavities, such a microspheres, can be concentrated or dispersed, as desired, for purposes such as enhancement of detection of signals from the particles or for filtering purposes. The control of fluid motion within the microcavities is carried out utilizing microstructures in the cavities having cantilever elements that are coupled to a substrate to receive vibrations therefrom. The cantilever elements can be excited into resonance at one or more resonant frequencies. By selection of the shape of the cantilever elements, their position in the microcavity, the spacing of the cantilever elements from the walls of the cavity, and the frequency at which the cantilever elements are excited, the direction of pumping of fluid through the cavity can be controlled, blocked, or diverted.

Exemplary microfluidic actuation apparatus in accordance with the invention includes a substrate, structural material on the substrate defining a cavity having a bottom wall, sidewalls, and a top wall, and an ultrasonic actuator in the cavity having a cantilever element projecting into the cavity that is spaced from the bottom wall and the top wall of the cavity. The cantilever element is coupled to the substrate to receive vibrations therefrom and has a resonant mode of vibration at a resonant frequency. An ultrasonic vibrator is coupled to the substrate outside of the cavity to transmit ultrasonic vibrations to the substrate and from the substrate to the cantilever element. The ultrasonic vibrator may comprise, for example, a high frequency driver such as a piezoelectric plate that is capable of vibrating at various frequencies from about 100 KHz to 10 MHz. Depending on the frequency of vibration applied to the substrate and thus to the actuators, the cantilever elements of the actuators may provide acoustic streaming of fluid in the cavity to pump fluid, as through a channel from one port to another, or may create vortices adjacent to the vibrating elements that trap or control the flow of fluid.

The ultrasonic actuators may be formed with various structures, including cantilever elements formed as plates extending outwardly from a pedestal fixed to the substrate and cantilever plates extending outwardly from a sidewall of the cavity.

Further objects, features and advantages of the invention will be apparent from the following detailed description when taken in conjunction with the accompanying drawings.

BRIEF DESCRIPTION OF THE DRAWINGS

In the drawings:

FIG. 7 is a simplified cross-sectional view of an initial step in the fabrication of actuation apparatus in accordance with the invention.

FIG. 8 is a view as in FIG. 7 at a further stage of processing.

FIG. 9 is a view of the structure of FIG. 8 at a further stage of processing.

FIG. 10 is a view as in FIG. 9 at a further stage of processing including patterning of a deposited polysilicon layer.

FIG. 11 is a view as in FIG. 10 at a further stage of processing after an oxide etch and formation of sidewalls.

FIG. 12 is a view as in FIG. 11 at a further stage of processing with a cover bonded to the sidewalls to form a completed structure.

FIG. 13 is a simplified side view of one type of actuator for illustration of the microfluidic effects that occur adjacent to the vibrating cantilever element.

DETAILED DESCRIPTION OF THE INVENTION

Figure 1:
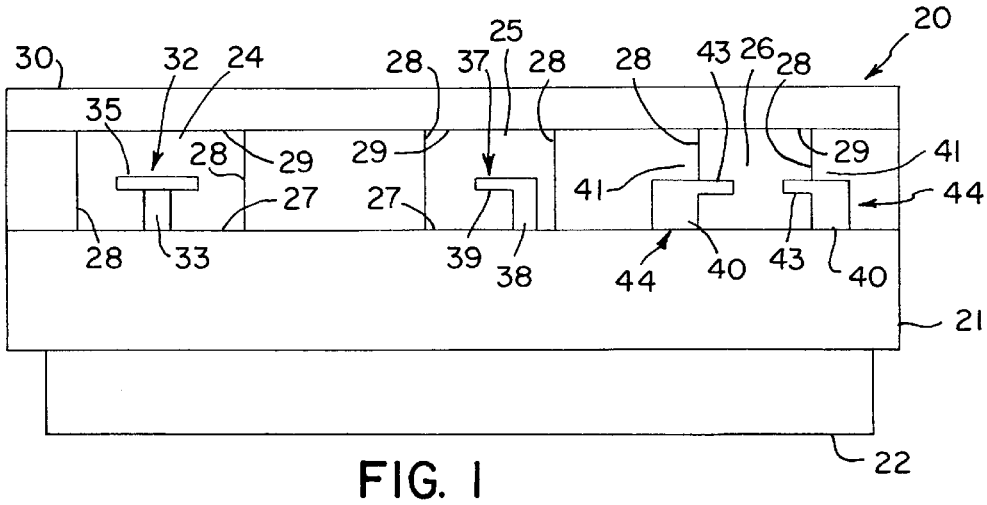
FIG. 1 is a simplified cross-sectional view of ultrasonic microfluidic actuation apparatus in accordance with the invention.

With reference to the drawings, a simplified cross-sectional view of ultrasonic microfluidic actuation apparatus is shown generally at 20 in FIG. 1 for exemplification of the invention. The microfluidic apparatus 20 includes a substrate 21 and an ultrasonic vibrator 22 coupled to the substrate to transmit ultrasonic vibrations thereto. The substrate 21 may be formed of various materials conventionally used in micromechanical systems, including ceramics, crystalline silicon, and so forth.

The illustrative apparatus 20 of FIG. 1 includes three microcavities 24, 25, and 26. The microcavity 24 is defined by a bottom wall 27, which may be the top surface of the substrate 21, side walls 28 formed of structural material deposited on the substrate 21, and a top wall 29 defined by the lower surface of a cover 30. A microfluidic actuator 32 is mounted in the cavity 24 and coupled to the substrate 21 to receive ultrasonic vibrations therefrom. The actuator 32 includes a pedestal 33, which is secured to the substrate 21 at the bottom wall 27, and a cantilever element 35 formed as a thin plate secured to the top of the pedestal 33 and extending outwardly from the pedestal 33 at a position spaced from the bottom wall 27 and the top wall 29. The cantilever plate element 35 may be formed as a circular disk or may have a square or other polygonal periphery.

The second cavity 25 is formed similarly to the cavity 24, having a bottom wall 27 defined by the top surface of the substrate 21, side walls 28 defined by material deposited on the substrate 21, and a top wall 29 formed by the bottom surface of the cover 30. An ultrasonic actuator 37 is mounted in the cavity 25 and includes an upright base portion 38 affixed to the substrate at the top surface 27 and a cantilevered element 39 extending outwardly from the base 38 at a position spaced from the bottom wall 27 and the top wall 29.

The cavity 26 is similarly defined by the bottom wall 27 comprising the top surface of the substrate 21 and the top wall 29 formed by the bottom surface of the cover 30. The side walls of the cavity 26 include a first section 40 formed of a first material deposited on the substrate 21 and a second section 41 defined by a second material formed on the substrate and over the first material defining the side walls 40. Cantilever elements 43 extend from each of the side walls 40 into the cavity 26, preferably toward each other as shown in FIG. 1, with the cantilever elements 43 being formed as thin flat plates which are spaced from the bottom wall 27 and the top wall 29. The cantilever elements 43 are coupled to the substrate 21 through the material defining the side walls 40 to receive ultrasonic vibrations therefrom. The cantilever elements 43 and the supporting structural material 40 together define an ultrasonic actuator 44.

Each of the cantilever elements 35, 39, and 43 have resonances at a resonant frequency at which the amplitude of the vibrations of the cantilever elements is greater than the amplitude of the vibration of the substrate 21 to which it is coupled and from which it receives the vibration. The vibration of the cantilever elements 35, 39 and 43 reacts with fluid in the cavities 23, 25, and 26 to create microvortices, as described further below, to provide pumping action of fluid in the cavities or mixing of fluid or both. The cavities 24, 25, and 26 may comprise elongated channels which extend from an input port to an output port and through which fluids are pumped, guided, mixed, blocked, or diverted by the actuators 32, 37, and 44. Although the actuators 32, 37 and 44 are shown for purposes of illustrating the invention, it is understood that any form of actuator geometry may be utilized that embodies the principles of the invention.

The ultrasonic vibrator 22 may comprise any ultrasonic driver capable of providing ultrasonic vibrations to the substrate 21 at appropriate frequencies. Suitable ultrasonic vibrators include piezoelectric drivers, magneto-strictive drivers, etc. It is a particular advantage of the present invention that the ultrasonic vibrator 22 is coupled to an exterior surface of the substrate 21 and transmits vibrations to the actuators 32, 37, and 44 through the substrate 21 rather than requiring actuating elements or drivers within the cavities or directly connected to the actuators within the cavities, as is conventionally done. Thus, in the present invention, there is no interaction between fluids in the micro cavities 24, 25, and 26 and the ultrasonic driver 22, and no need to run electrical wires or connectors through the substrate or through other structures to reach elements within the cavities.

Figure 2:
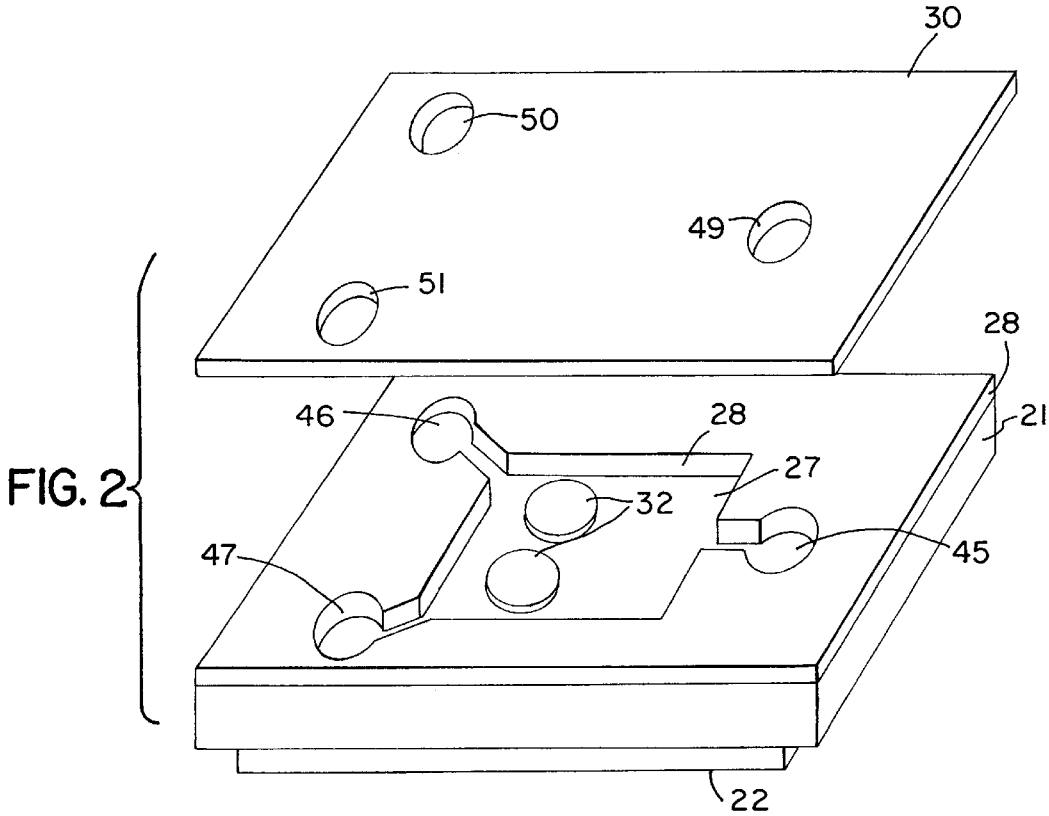
FIG. 2 is a perspective view of a partially assembled actuation apparatus in accordance with the invention having multiple ports.
Figure 3:
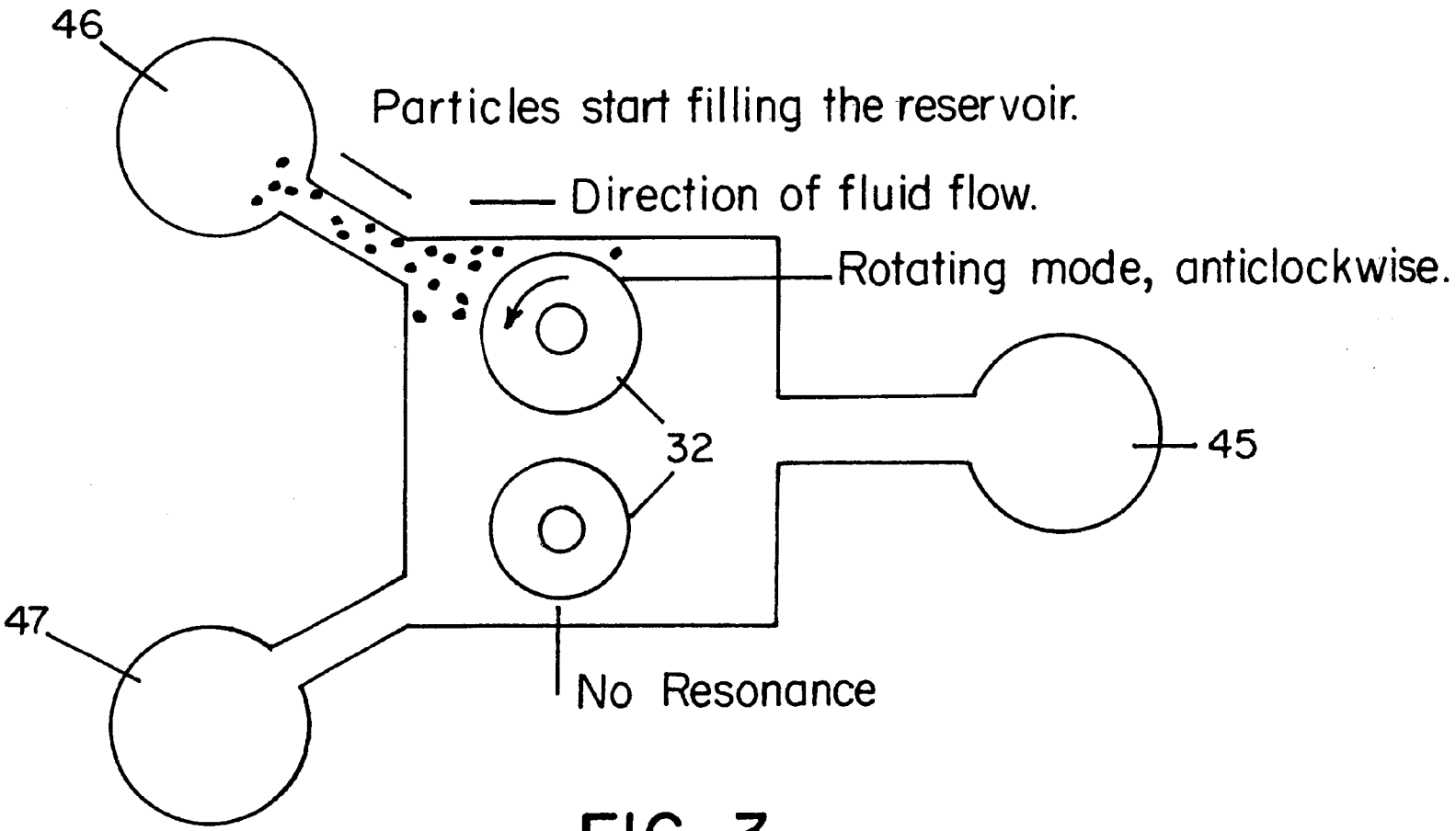
FIG. 3 is a simplified plan view of the cavity for the actuation apparatus of FIG. 2 illustrating the direction of flow under excitation at a first frequency.
Figure 4:
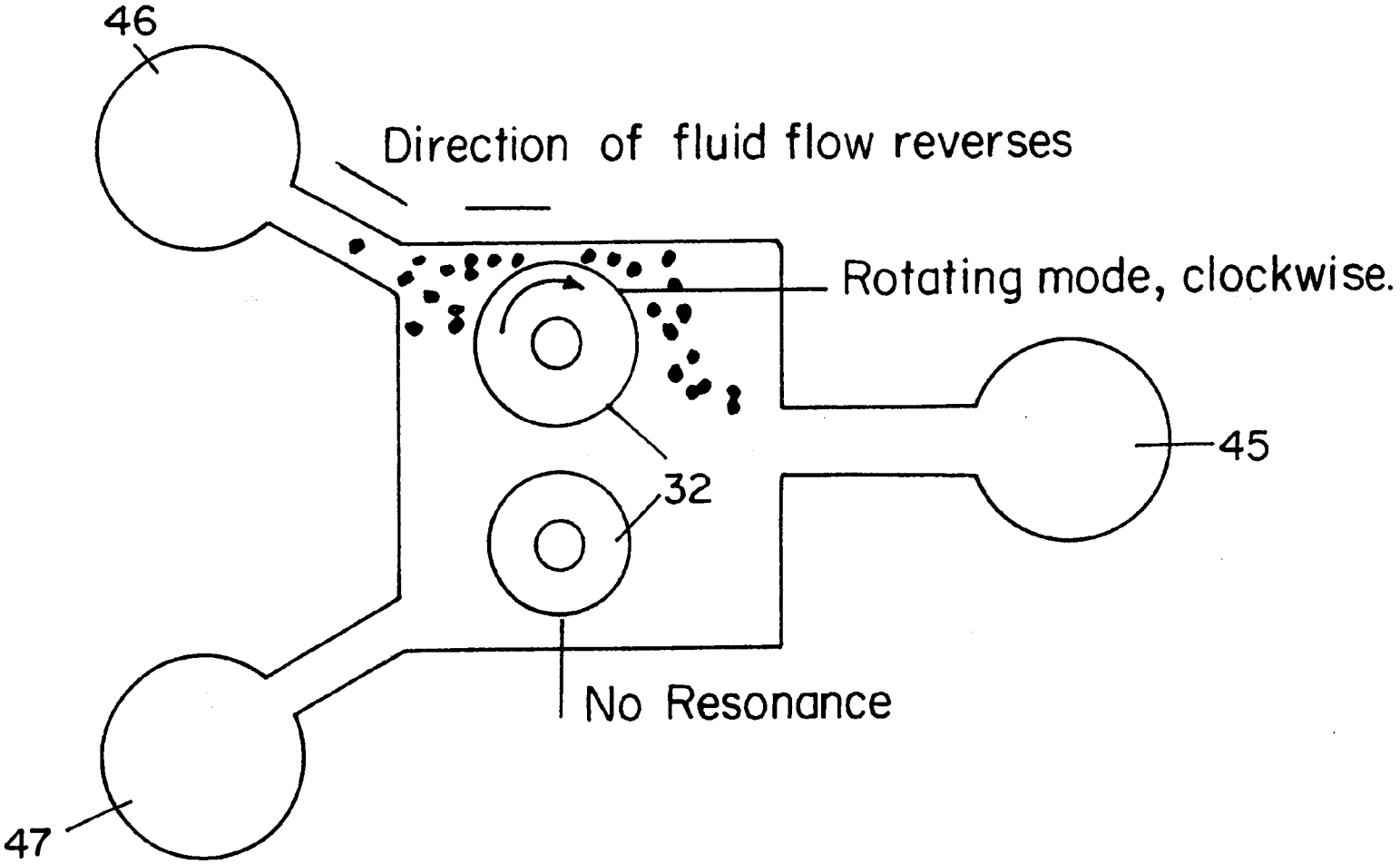
FIG. 4 is a simplified view of the cavity as in FIG. 3 illustrating flow through the cavity at a different excitation frequency.

FIG. 2 illustrates an embodiment of the invention utilizing the form of actuator 32 of FIG. 1 for directing fluid flow between an input port 45 and one of two output ports 46 or 47. The input port 45 is accessed through an opening 49 formed in the cover 30, and the output ports 46 and 47 are accessed through openings 50 and 51, respectively, formed in the cover 30. The two actuators 32 shown in FIG. 2 may be formed to have resonances at different frequencies, e.g., the width of the disks 35 for each actuator may be different to provide a different resonant frequency. As illustrated in FIG. 3, at a particular resonance frequency, the direction of a rotational mode in the disk 35 of the upper actuator 32 may be excited in a direction to direct fluid from the input port 45 to the first output port 46, whereas, as shown in FIG. 4, at a different frequency of excitation, flow may be directed in the reverse direction from the port 46 to the port 45 by virtue of a rotational mode of the disk 35 of the upper actuator 32 that rotates around the disk in the reverse direction from that shown in FIG. 3. At a different excitation frequency, the lower actuator 32 in FIGS. 3 and 4 may be driven into resonance to direct flow between the ports 45 and 47, in one direction or the other, while no resonance excitation of the upper actuator 32 occurs. Consequently, ultrasonic actuation apparatus as illustrated in FIGS. 2–4 may be utilized for both pumping fluids from one location to another and also for selectively directing the flow of fluid.

Figure 5:
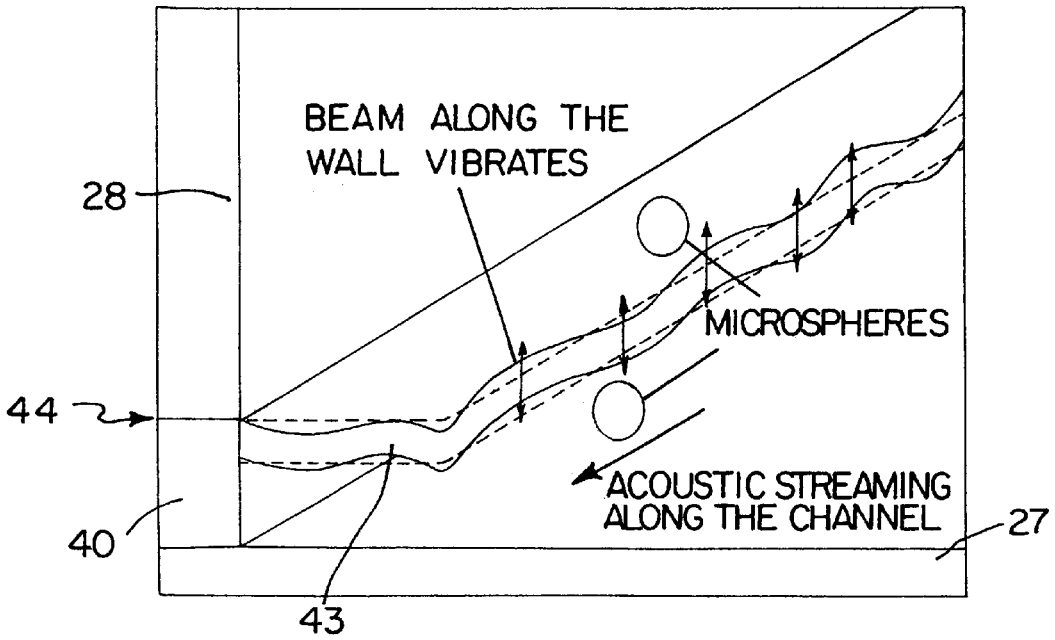
FIG. 5 is a partial perspective view of actuation apparatus in accordance with the invention having a cantilever plate extending outwardly from a sidewall of the cavity.

FIG. 5 illustrates the formation of longitudinally propagated resonances in the cantilevered side wall plates 43. Acoustic streaming drives fluid in one direction or the other along the length of the cantilever plate 43 as appropriate resonances with designed acoustic gradients are established in the cantilever plate.

For purposes of illustrating the principles of operation of the invention, a bulk piezoelectric lead zirconate titanate oxide (PZT) plate was bonded to a crystalline silicon die to form a laminate.

Figure 6:
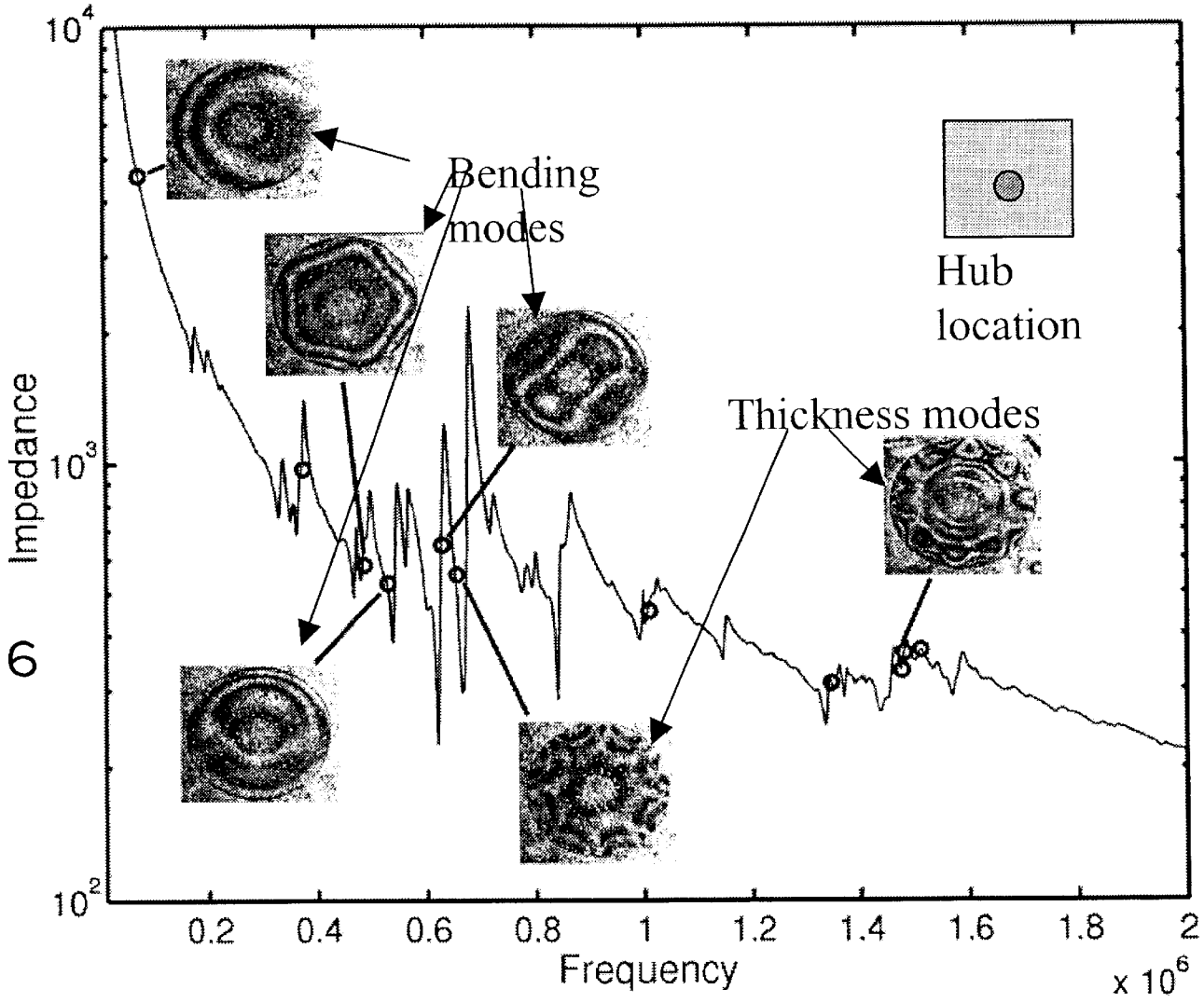
FIG. 6 are graphs illustrating the frequency response of an exemplary actuation apparatus and associated vibration modes of a disk structure mounted to the substrate of the apparatus.

The measured PZT/Si laminate electrical impedance and mode classes are shown in FIG. 6. For frequencies less than 1 MHz the vibration energy is mostly in thickness type modes. In general the mode shapes can be complicated and simple analytical solutions may not exist.

The resonating surface micromachines as illustrated at 32, 37, and 44 in FIG. 1 introduce additional vibrations and acoustic field gradients in the microfluid channels. The microstructures can be actuated by exciting the PZT/Si laminate at frequencies coinciding with the microstructure resonance frequencies of the actuators 32, 37 and 44.

To characterize the disk resonances of actuators having the form of the actuator 32, a phase-locked diode laser interferometer and a CCD camera were used. This interferometric visualization was done in vacuum (<100 m Torr) to eliminate the viscous damping due to air or water.

Disk resonances with a five fold radial symmetry were found which extend around the disks 35 of the actuators 32. The vibration amplitude was as high as 2.5 $\mu$m, measured by counting the fringes. In addition to the standing wave patterns, rotating modes (θ-directed traveling waves) of anchored disks 35 were also excited. These rotating modes appeared at a frequency slightly off the fundamental standing mode resonance frequency and showed a frequency hysteresis associated with the non-linear spring constants.

Acoustic streaming can be attributed to the nonlinear convective mass transport due to gradients in acoustic fields. Nyborg and others have used the method of successive approximation to derive an effective force field due to acoustic gradients that move the liquid. See W. L. Nyborg, "Acoustic Streaming, " in Vol. 2B, of *Physical Acoustics*, Academic Press, New York, 1949, pp. 1415–1422. This force field is of the type $$F=-[P(v_a\cdot\nabla)v_a+v_a\tilde{\nabla}\cdot P\tilde{v}_a] \quad (1)$$

where $v_a$ is the acoustic velocity field calculated using linear acoustic methodologies and the mark "" denotes a vector quantity. The force field derived from Eq. 1 is used in the creeping flow equation to obtain the acoustic streaming flow pattern. The boundary motion due the presence of a transducer also gives rise to a flow due to boundary nonlinearity but is not important when the transducer displacement is much smaller than the device dimensions. See C. F. Bradley, "Acoustic Streaming Field Structure: The Influence of the Radiator," J. of Acoustical Society of America, Vol. 100, No. 3, September 1996, pp. 1399–1408.

The solutions to the linear acoustic problem for complicated structures in microfluidic channels is analytically intractable. Numerical finite element method (FEM) solutions are possible for the linear acoustic problem. FEM modeling is required both at the micron and the millimeter scale, requiring very high mesh densities. However, useful intuition of device operation can be obtained by studying classes of acoustic streaming. In fact, the microfluidic channel filled with microstructures driven at a widely varying range of frequencies provides an interesting test case to categorize acoustic streaming flows. A vibrating surface, much smaller than the acoustic wavelength, generates local vortices resulting in "microstreaming, " a term coined by Nyborg. For example, a wire vibrating transversely results in vortices and a longitudinal actuator results in vortices. See Nyborg, supra. Oscillating spheres result in vortices as well. N. Amin, et al., "Streaming From a Sphere Due to a Pulsating Sound, " J. of Fluid Mechanics, Vol. 210, Jan. 1990, pp. 459–473. In cases where the device size is larger than the acoustic wavelength, gradients of the acoustic field over wavelength can also lead to vortices and linear flow.

An exemplary process for fabrication of the microfluidic actuation apparatus of the invention is shown in FIGS. 7–12. The steps are as follows:

1. Anchoring 4.5 $\mu$m thick oxide layer 50 as shown in FIG. 7 was grown by successive LPCVD polysilicon depositions and thermal oxidations on a silicon wafer which will comprise the substrate 21. The center anchor for the disk structures was created by lithographic patterning followed by an oxide etch using 6:1 buffered oxide etch (BOE) to form openings 52 in the oxide 50 as shown in FIG. 8. The high thickness of the oxide 50 ensured that the final circular disk structures do not get stuck to the substrate during the release and that 2 $\mu$m diameter polystyrene balls used to visualize the fluid flow could go under and come out beneath the disk 35 without getting stuck.

2. Polysilicon Deposition and Patterning

After depositing polysilicon pedestal anchors 33 in the openings 52, as shown in FIG. 9, a 1.2 $\mu$m polysilicon deposition was done at 580° C. followed by a 900° C. stress anneal. The polysilicon disks and walls were then patterned by a reactive ion etching (RIE) etch, as illustrated in FIG. 10.

3. Cap Fabrication

SU-8 (a photopolymerizable polymer commonly used as a negative photoresist, available from MicroPosit of Germany) walls 28 with a glass cover 30 on top were fabricated by first removing oxide around the disk actuators with 6:1 BOE etch, as shown in FIG. 11. Next, a 50 $\mu$m thick SU-8 coating was spun and patterned. Stress related problems that result in poor adhesion of SU-8 to the substrate were solved by avoiding high thermal stresses. After SU-8 patterning, the disk actuators were released with a 49% HF etch, as shown in FIG. 12. Finally, a 5 $\mu$m thick layer of SU-8 was used to bond the glass cover 30 to the walls 28. Laser drilled orifices (not shown in FIG. 12) in the glass cover as the entry point for the pipes used for injecting fluid into the cavity 24.

4. PZT Bonding

The released and capped device shown in FIG. 12 was then adhesively bonded to a piezoelectric plate 22 (PZT-4H, Lead-Zirconate-Titanate) using cyanoacrylate.

The following discusses experimental fluidic results with the device fabricated as discussed above. In all experiments, the PZT 22 was actuated with a 10 V peak-to-peak amplitude (when driving a 50 ohm load). The actual voltage across the PZT varied due to the frequency dependency of the PZT impedance and was less than 10 V. The observations were made with an optical microscope, and the fluid motion was visualized with 2 $\mu$m polystyrene spheres.

For frequencies less than 1 MHz, the fluid actuation is found to be controlled by the flexural modes and the location of the disk actuators inside the channel. The structural dimensions of the surface microactuators are much smaller than the acoustic wavelength (1.5–7.5 mm for 0.1–1 MHz drive), and the microstructure acts as a scattering dipole source, resulting in large vortices. Fluid vortices in the channel at locations other than the actuators 32 were also observed near the polystyrene bead clusters. These 10–30 $\mu$m clusters are believed to act as a scattering source in the same way as the disk actuators.

At frequencies between 1–10 MHz, the vibration energy is mainly in the thickness modes, as illustrated in FIG. 13. At these frequencies, the acoustic wavelength is approximately 150–1500 $\mu$m. Another important length scale is the evanescent field decay length, which is the extent of a non-propagating acoustic field in the fluid because the flexural plate wave phase velocity is smaller than the fluid acoustic velocity. See R. M. Moroney, supra. The evanescent decay length at the 3–5 MHz frequency range is 30–50 $\mu$m. Using a dimensional argument, the near unity device-to-wavelength ratio and the near unity channel-height-to-evanescent-decay-length ratio implies acoustic field variation both in the vertical and radial directions in the vicinity of the circular plate.

These actuators 32 can be used to amplify motion by selectively resonating them in the frequency range discussed above. It is possible to control fluid motion by frequency addressing the disk actuators. As an example, rotating modes caused microspheres to travel around the disk at velocities exceeding 7000 $\mu$m/s. The rotating modes were used for bidirectional pumping as illustrated in FIGS. 3 and 4. With the excitation of anti-clockwise rotating mode, the polystyrene balls moved to the left, filling the reservoir 46. As the reservoir fills up with the liquid, the increased pressure slows the actuated fluid flow. By changing the drive frequency, a clockwise rotating mode is excited that pumps the liquid in the opposite direction, as shown in FIG. 4. The flow direction could be changed repeatedly.

Microfluidic vortices were found to be formed along the periphery of the actuators 32, as illustrated by the shear-viscous vortex shown at 60 in FIG. 13. These vortices effectively trap the microspheres passing by the disk. This effect can be used for filtering, mixing, collecting, and accumulating particles.

The edge vortex formation can be explained by plate edge shear viscous coupling into the fluid. The shear viscous depth is $\sqrt{v/\omega}$, the length scale over which the shear motion is coupled to the fluid. Here, v is the kinematic viscosity and $\omega$ is the frequency. This length ranges from 2 $\mu$m at 100 kHz to 0.2 $\mu$m at 10 MHz for water. Thus, the fact that the shear viscous depths are of the same order as the plate thickness and the plate substrate gap implies large variants near the plate edges, resulting in the observed edge vortices.

The polysilicon sidewall cantilever elements 43 were also excited at 500–600 kHz and 3–5 MHz, resulting in a traveling wave pattern of flexural waves along the wall of the channel with amplitude gradients at the corners. This effectively pumped the liquid along the wall edges.

In summary, the important dimensional considerations include the acoustic wavelength, the shear viscous depth, the gap between the cantilever elements and the bottom wall 27, the height of the cavity (distance between bottom wall 27 and top wall 29), and the evanescent decay length. The vibrational excitation frequency determines the microfluidic effects. For example, for devices having the structures and dimensions shown in FIG. 13, at applied frequencies of 100 KHz to 1 MHz, the acoustic wavelength in water is about 1.55 mm to 7.5 mm. The dimensions of the actuators 32 (e.g., the thicknesses and widths of the cantilever elements 35, 37 and 43) are much smaller than the acoustic wavelength, and acoustic streaming occurs in the fluid. At applied frequencies of 1 MHz to 10 MHz, the acoustic wavelength is about 150 $\mu$m to 1500 $\mu$m, which is near the dimensions of the actuators, and the cavity height is near the evanescent decay length (30 to 50 $\mu$m), which implies acoustic field gradients in the fluid near the actuators.

It is understood that the invention is not limited to the embodiments set forth herein for illustration, but embraces all such forms thereof as come within the scope of the following claims.

What is claimed is:

1. Ultrasonic microfluidic actuation apparatus comprising:

(a) a substrate;

(b) structural material on the substrate defining a cavity having a bottom wall, side walls, and a top wall;

(c) an ultrasonic actuator in the cavity having a cantilever element projecting into the cavity that is spaced from the bottom wall and the top wall of the cavity and that is coupled to the substrate to receive vibrations therefrom, the cantilever element having a resonant mode of vibration at a resonant frequency; and (d) an ultrasonic vibrator coupled to the substrate outside of the cavity to transmit ultrasonic vibrations to the substrate and from the substrate to the cantilever element.

2. The microfluidic actuations apparatus of claim 1 wherein the height of the cavity from the bottom wall to the top wall is less than 100 $\mu$m.

3. The microfluidic actuation apparatus of claim 1 wherein the width of the cavity between the side walls is less than 1,000 $\mu$m.

4. The microfluidic actuation apparatus of claim 1 wherein the ultrasonic actuator comprises a pedestal fixed to the substrate within the cavity and the cantilever element comprises a plate fixed to the pedestal and extending outwardly therefrom between the top wall and the bottom wall.

5. The microfluidic actuation apparatus of claim 4 wherein the plate is a circular disk.

6. The microfluidic actuation apparatus of claim 1 wherein there are multiple ultrasonic actuators within the cavity each comprising a pedestal fixed to the substrate and wherein the cantilever element of each comprises a circular disk fixed to the pedestal and extending outwardly therefrom between the top wall and the bottom wall.

7. The microfluidic actuation apparatus of claim 1 wherein the cantilever element comprises a plate fixed to and extending outwardly from a side wall of the cavity between the bottom wall and the top wall.

8. The microfluidic actuation apparatus of claim 7 wherein the cantilever element comprises a plate fixed to and extending outwardly from each of the side walls of the cavity between the top wall and the bottom wall.

9. The microfluidic actuation apparatus of claim 1 wherein the cavity comprises an elongated channel extending from an input port to an output port.

10. The microfluidic actuation apparatus of claim 1 wherein the substrate is formed of crystalline silicon and the actuator is formed of polysilicon secured to the substrate.

11. The microfluidic actuation apparatus of claim 1 wherein the ultrasonic vibrator comprises a PZT plate secured to a bottom outside surface of the substrate that is opposite to a surface of the substrate defining the bottom wall of the cavity.

12. The microfluidic actuation apparatus of claim 1 wherein there are multiple ultrasonic actuators mounted in the cavity spaced from each other, each actuator having a different resonating frequency of the cantilever elements thereof.

13. Ultrasonic microfluidic actuation apparatus comprising:

(a) a substrate;

(b) structural material on the substrate defining a cavity having a bottom wall, side walls, and a top wall, wherein the height of the cavity from the bottom wall to the top wall is less than 100 $\mu$m;

(c) an ultrasonic actuator in the cavity comprising a pedestal fixed to the substrate within the cavity and a cantilever element comprising a plate fixed to the pedestal and extending outwardly therefrom between the top wall and the bottom wall, the actuator coupled to the substrate to receive vibrations therefrom, the cantilever element having a resonant mode of vibration at a resonant frequency; and (d) an ultrasonic vibrator coupled to the substrate outside of the cavity to transmit ultrasonic vibrations to the substrate and from the substrate to the cantilever element.

14. The microfluidic actuation apparatus of claim 13 wherein the width of the cavity between the sidewalls is less than 1,000 $\mu$m.

15. The microfluidic actuation apparatus of claim 13 wherein the plate is a circular disk.

16. The microfluidic actuation apparatus of claim 13 wherein there are multiple ultrasonic actuators within the cavity each comprising a pedestal fixed to the substrate and wherein the cantilever element of each comprises a circular disk fixed to the pedestal and extending outwardly therefrom between the top wall and the bottom wall.

17. The microfluidic actuation apparatus of claim 16 wherein each actuator has a different resonating frequency of the cantilever elements thereof.

18. The microfluidic actuation apparatus of claim 13 wherein the cavity comprises an elongated channel extending from an input port to an output port.

19. The microfluidic actuation apparatus of claim 13 wherein the substrate is formed of crystalline silicon and the actuator is formed of polysilicon secured to the substrate.

20. The microfluidic actuation apparatus of claim 13 wherein the ultrasonic vibrator comprises a PZT plate secured to a bottom outside surface of the substrate that is opposite to a surface of the substrate defining the bottom wall of the cavity.

21. A method of actuating fluid in microcavities comprising:

(a) providing a microfluidic structure including a substrate, a structural material on the substrate defining a cavity having a bottom wall, sidewalls and a top wall, and an ultrasonic actuator in the cavity having a cantilever element projecting into the cavity that is spaced from the bottom wall and the top wall of the cavity and that is coupled to the substrate to receive vibrations therefrom, the cantilever element having a resonant mode of vibration at a resonant frequency;

(b) providing fluid to the cavity; and (c) coupling an ultrasonic vibrator to the substrate and applying ultrasonic vibrations from the vibrator through the substrate to the ultrasonic actuator at a frequency that vibrates the cantilever element in a resonant mode of vibration.

22. The method of claim 21 wherein the ultrasonic vibrator provides vibrations through the substrate to the cantilever element at applied frequencies in the range of 100 KHz to 1 MHz and wherein the thickness and width of the vibrating element of the microactuator is much smaller than the acoustic wavelength in the fluid in the microcavity at the applied frequency of vibration such that acoustic streaming occurs.

23. The method of claim 21 wherein the ultrasonic vibrator applies vibrations through the substrate to the vibrating cantilever element at a frequency in the range of 1 MHz to 10 MHz such that the acoustic wavelength in the fluid in the cavity is near the dimensions of the actuator such that there are acoustic field gradients in the fluid near the actuators.

24. The method of claim 21 wherein the ultrasonic actuator in the cavity comprises a pedestal fixed to the substrate within the cavity and the cantilever element comprises a circular disk fixed to the pedestal and extending outwardly therefrom between the top wall and the bottom wall of the cavity, and wherein the ultrasonic vibrator provides ultrasonic vibrations through the substrate to the disk at a frequency which drives the disk into resonant vibrations in a bending mode.

25. The method of claim 21 wherein the ultrasonic actuator in the cavity comprises a pedestal fixed to the substrate within the cavity and the cantilever element comprises a circular disk fixed to the pedestal and extending outwardly therefrom between the top wall and the bottom wall of the cavity, and wherein the ultrasonic vibrator provides ultrasonic vibrations through the substrate to the disk at a frequency which drives the disk into resonant vibrations in a thickness mode.

26. The method of claim 21 wherein the cantilever element of the ultrasonic actuator comprises a thin plate fixed to and extending outwardly from a sidewall of the cavity between the bottom wall and the top wall, and wherein the ultrasonic vibrator provides ultrasonic vibration through the substrate to the plate comprising the cantilever element to drive the plate into resonance to provide acoustic streaming and pumping of fluid in the cavity.

* * * * *